US009322254B2

(12) United States Patent
Trautman et al.

(10) Patent No.: US 9,322,254 B2
(45) Date of Patent: Apr. 26, 2016

(54) METHOD FOR HYDROCARBON RECOVERY USING HEATED LIQUID WATER INJECTION WITH RF HEATING

(75) Inventors: Mark Alan Trautman, Melbourne, FL (US); Daniel Sultenfuss, Houston, TX (US)

(73) Assignees: HARRIS CORPORATION, Melbourne, FL (US); CONOCOPHILLIPS COMPANY, Houston, TX (US)

( * ) Notice: Subject to any disclaimer, the term of this patent is extended or adjusted under 35 U.S.C. 154(b) by 1045 days.

(21) Appl. No.: 13/276,381

(22) Filed: Oct. 19, 2011

(65) Prior Publication Data

US 2013/0098610 A1 Apr. 25, 2013

(51) Int. Cl.
*E21B 43/20* (2006.01)
*E21B 43/24* (2006.01)

(52) U.S. Cl.
CPC ..... *E21B 43/20* (2013.01); *E21B 43/2401* (2013.01)

(58) Field of Classification Search
None
See application file for complete search history.

(56) References Cited

U.S. PATENT DOCUMENTS

| | | | | | |
|---|---|---|---|---|---|
| 3,262,500 | A * | 7/1966 | Waterman | 166/52 |
| 3,605,888 | A | 9/1971 | Crowson et al. | |
| 4,193,451 | A * | 3/1980 | Dauphine | 166/248 |
| 4,376,034 | A * | 3/1983 | Wall | 208/402 |
| 4,458,945 | A * | 7/1984 | Ayler et al. | 299/2 |
| 4,679,626 | A * | 7/1987 | Perkins | 166/248 |
| 5,046,559 | A | 9/1991 | Glandt | 166/248 |
| 5,056,596 | A | 10/1991 | McKay et al. | 166/272 |
| 6,012,520 | A * | 1/2000 | Yu et al. | 166/245 |
| 7,091,460 | B2 * | 8/2006 | Kinzer | 219/772 |
| 8,646,524 | B2 * | 2/2014 | Al-Buraik | 166/248 |
| 2006/0102625 | A1 * | 5/2006 | Kinzer | 219/772 |
| 2007/0187089 | A1 * | 8/2007 | Bridges | 166/248 |
| 2007/0261844 | A1 | 11/2007 | Cogliandro et al. | 166/266 |
| 2008/0073079 | A1 * | 3/2008 | Tranquilla et al. | 166/270.1 |
| 2008/0087420 | A1 * | 4/2008 | Kaminsky | E21B 41/0064 166/245 |
| 2008/0087427 | A1 * | 4/2008 | Kaminsky | E21B 41/0064 166/272.1 |
| 2009/0050318 | A1 * | 2/2009 | Kasevich | 166/248 |
| 2009/0071648 | A1 * | 3/2009 | Hagen et al. | 166/272.1 |
| 2009/0242196 | A1 * | 10/2009 | Pao | 166/248 |
| 2009/0255661 | A1 * | 10/2009 | Clark et al. | 166/50 |
| 2010/0078163 | A1 | 4/2010 | Banerjee et al. | 166/248 |
| 2010/0276148 | A1 * | 11/2010 | Wylie et al. | 166/303 |
| 2010/0294488 | A1 | 11/2010 | Wheeler et al. | |
| 2010/0294489 | A1 | 11/2010 | Dreher, Jr. et al. | 166/248 |
| 2014/0027109 | A1 * | 1/2014 | Al-Buraik | 166/248 |

* cited by examiner

*Primary Examiner* — Angela M DiTrani
*Assistant Examiner* — Anuradha Ahuja
(74) *Attorney, Agent, or Firm* — Allen, Dyer, Doppelt, Miltbrath & Gilchrist, P.A.

(57) ABSTRACT

A method for hydrocarbon resource recovery in a subterranean formation includes forming a laterally extending injector well in the subterranean formation and forming a laterally extending producer well spaced below the injector well. The method may also include radio frequency (RF) heating the subterranean formation to establish hydraulic communication between the injector well and the producer well. The method may further include injecting heated liquid water into the injector well to recover hydrocarbon resources from the producer well based upon the hydraulic communication therebetween.

26 Claims, 11 Drawing Sheets

METHOD FOR HYDROCARBON RECOVERY USING HEATED LIQUID WATER INJECTION WITH RF HEATING

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/producer wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

Unfortunately, long production times to extract oil using SAGD may lead to significant heat loss to the adjacent soil, excessive consumption of steam, and a high cost for recovery.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 5,046,559 to Glandt discloses a method for producing oil from tar sands by electrically preheating paths of increased injectivity between an injector well and a pair of producer wells arranged in a triangular pattern. The paths of increased injectivity are then steam flooded to produce the hydrocarbon resources.

Unfortunately, SAGD may not efficiently permit recovery of the hydrocarbon resources in that SAGD may have increased capital and energy costs, for example, as disclosed in U.S. Patent Application Publication No. 2010/0276148 to Wylie et al. Wylie et al. discloses combusting a fuel mixture so that combustion gases with relatively high levels of carbon dioxide, steam, and/or hot water are used to improve recovery of heavy hydrocarbons. In particular, a gas, fluid water, and carbon dioxide are delivered to the heavy hydrocarbon material. The gas may be heated by microwave RF heating. Still, further efficiency in hydrocarbon recovery may be desired.

SUMMARY OF THE INVENTION

In view of the foregoing background it is therefore an object of the present invention to provide a method for more efficiently recovering hydrocarbon resources from a subterranean formation while potentially using less energy and providing faster recovery of the hydrocarbons.

These and other objects, features and advantages of the present invention are provided by a method for hydrocarbon resource recovery in a subterranean formation which includes forming a laterally extending injector well in the subterranean formation and forming a laterally extending producer well spaced below the injector well. The method includes RF heating the subterranean formation to establish hydraulic communication between the injector well and the producer well. The method also includes injecting heated liquid water into the injector well to recover hydrocarbon resources from the producer well based upon the hydraulic communication therebetween. Accordingly, less overall energy may be used to recover the hydrocarbon resources. Faster and increased oil recovery can also be achieved.

The method may further include positioning a respective RF applicator within the injector well and the producer well, for example. The RF heating may include supplying RF energy to each of the RF applicators.

An additional injector well may be formed in the subterranean formation to define a pair of laterally spaced apart injector wells, for example. The producer well may be formed between the pair of injector wells. The producer well may be positioned midway between the pair of spaced apart injector wells, for example.

The method may further include heating the heated liquid water in a pressure vessel above the subterranean formation. The heated liquid water may be injected at a pressure in a range of 0.4 to 4 MPa, and a temperature in a range of 100-200° C.

The method may further include injecting a gas into the injector well. The gas may be injected before the heated liquid water is injected, for example. Alternatively, the gas may be injected after the RF heating. The gas and the heated liquid water may also be injected at a same time, for example.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should riot be construed as limited to the illustrated embodiments set forth herein. Rather, these embodiments are provided so that this disclosure will be thorough and complete, and will fully convey the scope of the invention to those skilled in the art. The terminology used herein is for the purpose of describing particular embodiments only and is not intended to be limiting of the invention. As used herein, the singular forms "a", "an" and "the" are intended to include the plural forms as well, unless the context clearly indicates otherwise. Like numbers refer to like elements throughout.

Figure 1:
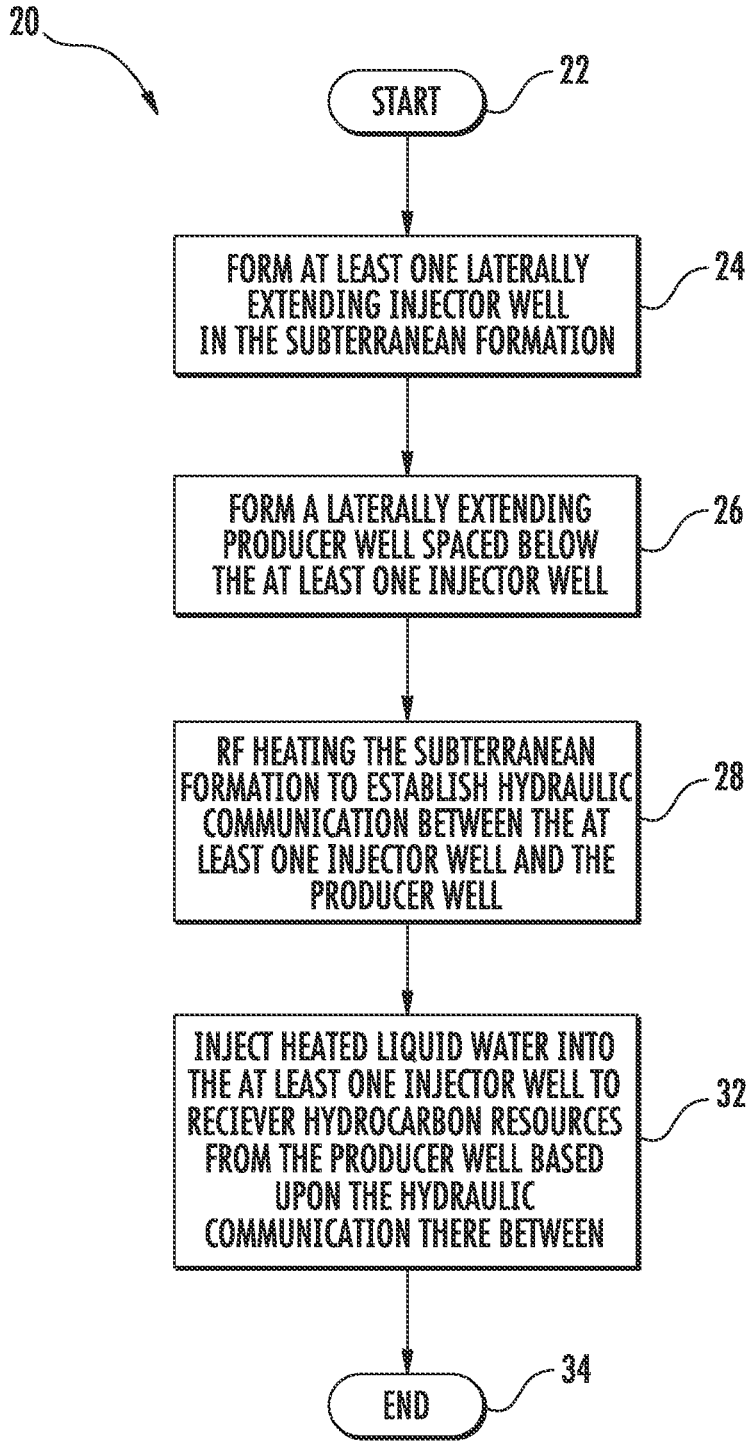
FIG. 1 is a flowchart for the method in accordance with the invention.

Referring initially to the flowchart 20 in FIG. 1, beginning at Block 22 a method for hydrocarbon resource recovery in a subterranean formation 41 includes forming a pair of spaced apart laterally extending injector wells 42*a*, 42*b* in the subterranean formation (Block 24). The subterranean formation 41 may include an oil sand formation, for example. The method also includes forming a laterally extending producer well 43 spaced below the pair of spaced apart injector wells 42*a*, 42*b* (Block 26). The laterally extending producer well 43 may be positioned midway between the pair of spaced apart laterally extending injector wells 42*a*, 42*b*. Of course, in some embodiments, a single injector well, or more than a pair of injector wells may be used.

Figure 2:
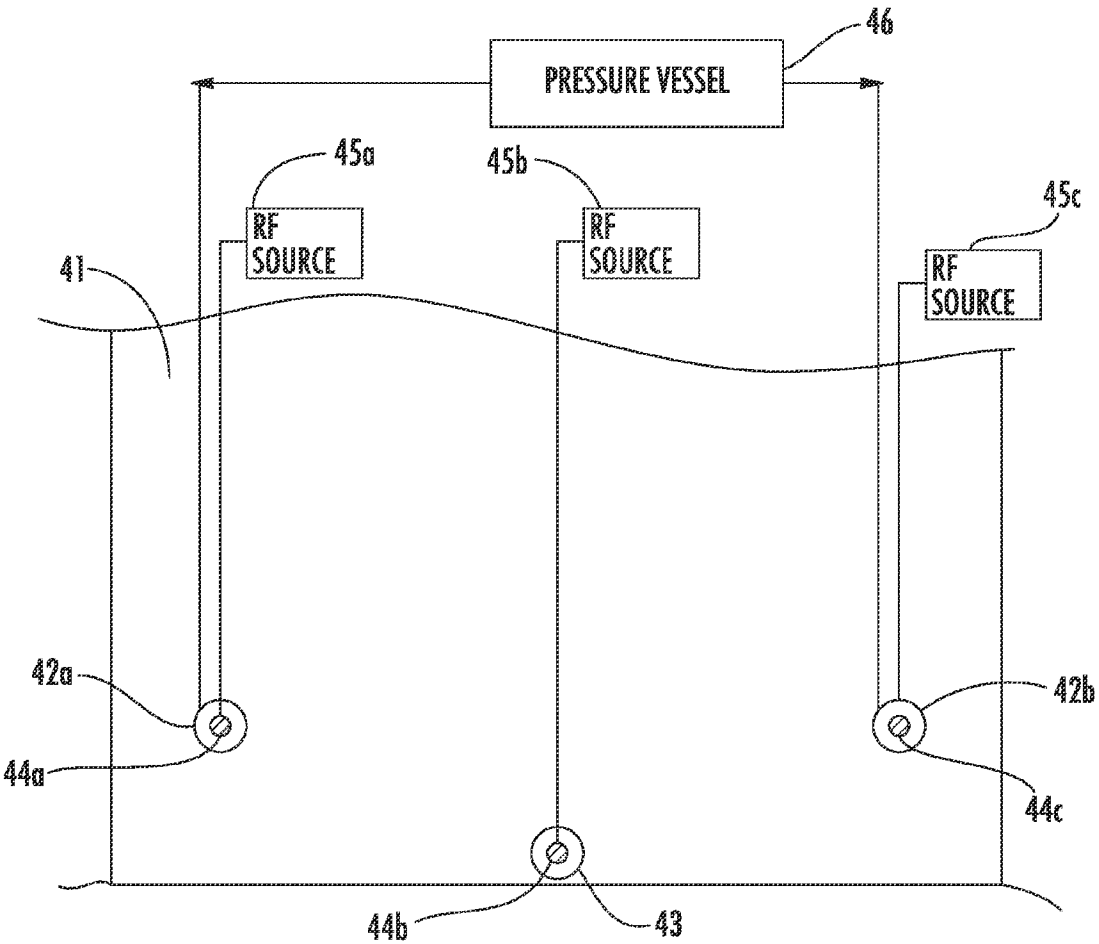
FIG. 2 is a schematic cross-sectional view of a hydrocarbon bearing subterranean formation.

The spaced apart laterally extending injector wells 42*a*, 42*b*, may be spaced apart by 100 meters, for example. The laterally extending producer well 43 may be positioned between the pair of spaced apart laterally extending injector wells 42*a*, 42*b*, in a range of 25 to 50 meters from each of the injector wells. Of course, other well spacing configurations may be used. An exemplary configuration between the pair of laterally extending injector wells 42*a*, 42*b*, and the laterally extending producer well is illustrated in FIG. 2.

At Block 28, the method includes RF heating the subterranean formation 41, to establish hydraulic communication between the injector wells 42*a*, 42*b*, and the producer well 43. To accomplish the RF heating, the method includes positioning respective RF applicators 44*a*-44*c* within the injector wells 42*a*, 42*b*, and the producer well 43. Each RF applicator 44*a*-44*c* may be in the form of one or more conductors configured to define an antenna for example, as will be appreciated by those skilled in the art. RF energy is supplied to each of the RF applicators 44. A respective RF source 45*a*-45*c* may be collocated with the pair of laterally extending injector wells 42*a*, 42*b*, and the producer well 43, for example. Alternatively, a single RE source may be used.

In other embodiments, the respective RF applicators 44*a*-44*c* may be positioned between the injector wells 42*a*, 42*b*, and the producer well 43. Of course, additional or fewer RF applicators may be used. For example, an RF applicator may be positioned between well pairs. Since a hydrocarbon resource in its native condition generally resists fluid injection, RF heating advantageously increases the temperature of the subterranean formation 41 to a temperature at which the hydrocarbon resource becomes mobile, i.e. has a reduced viscosity to establish the hydraulic communication.

RF heating may continue for a time period of two years, for example, or to a desired temperature. More particularly, the RF heating may continue until the subterranean formation 41 is at least 60° C., for example. The subterranean formation 41 may be, in many instances, in a temperature range of 4-10° C. prior to the RF heating. The duration of the RE heating may be based upon the temperature and conditions of the subterranean formation 41 as will be appreciated by those skilled in the art.

To achieve the desired RF heating, 4 megawatts of power at a frequency in a range of 20 kHz-300 MHz, may be applied from the RF source 45 to each RF applicator 44, for example, for a 1000 meter zone. Other frequency ranges and powers may be used for the RF heating.

The method also includes, at Block 32 injecting heated liquid water into the pair of spaced apart laterally extending injector wells 42*a*, 42*b* to recover hydrocarbon resources from the producer well 43 based upon the hydraulic communication therebetween. The heated liquid water is heated in a pressure vessel 46 above the subterranean formation 41. The heated liquid water may be heated under pressure, for example, at 1.5 MPa, so that the boiling point becomes 200° C. The heated liquid water is injected at a pressure in a range of 0.4 to 4 MPa, and a temperature in a range of 100-200° C., and more particularly, 150° C. so that dissolved solids within the heated liquid water are not boiled out. In other words, hot liquid water is used and not steam.

The heated liquid water further heats the subterranean formation 41 to reduce the hydrocarbon viscosity and displace the hydrocarbon resource from each of the pair of spaced apart laterally extending injector wells 42*a*, 42*b* to the laterally extending producer well 43. Using injected heated liquid water versus steam in conventional SAGD, for example, to heat the subterranean formation 41 advantageously reduces the amount of energy consumed to displace the hydrocarbon resource, as an increase in temperature corresponds to an increase in energy consumed. As will be appreciated by those skilled in the art, an increased amount of energy is needed to change the steam from a liquid to a gas. More particularly, compared to conventional SAGD, a steam plant is typically not needed, and a capacity of water treatment facilities may be reduced.

The heated liquid water injection may improve overall hydrocarbon recovery relative to a pure gas injection, for example, a non-condensable gas, as the heated liquid has a better mobility ratio with the hydrocarbon resource as compared to a gas. This may result in increased sweep efficiency and increased hydrocarbon recovery prior to breakthrough, as will be appreciated by those skilled in the art. The heated liquid water may be injected for a time period of two years, for example, as after a total of three years, significant hydrocarbon resources have been recovered. Longer or shorter water injection durations are also possible.

As will be appreciated by those skilled in the art, the RF heating preheats the subterranean formation 41 between the wells bringing the subterranean formation to a sufficient temperature so that the heated liquid water may be injected. As will be appreciated by those skilled in the art, preheating the subterranean formation 41 at any relatively significant distance away from a well with a fluid, for example, the heated liquid water, is increasingly difficult because the properties of the subterranean formation 41 at the initial temperature, i.e. prior to RF heating, resist fluid injection. Initially, heating the subterranean formation 41, for example, the wellbore region, with a fluid thus proceeds through heat conduction, which is relatively slow.

Advantageously, RF heating generally does not require any injectivity to heat the subterranean formation 41. For example, in subterranean formations with relatively poor injectivity, traditional methods of introducing heat through gas or liquid injection may not possible without fracturing the subterranean formation. The method ends at Block 34.

Figure 3:
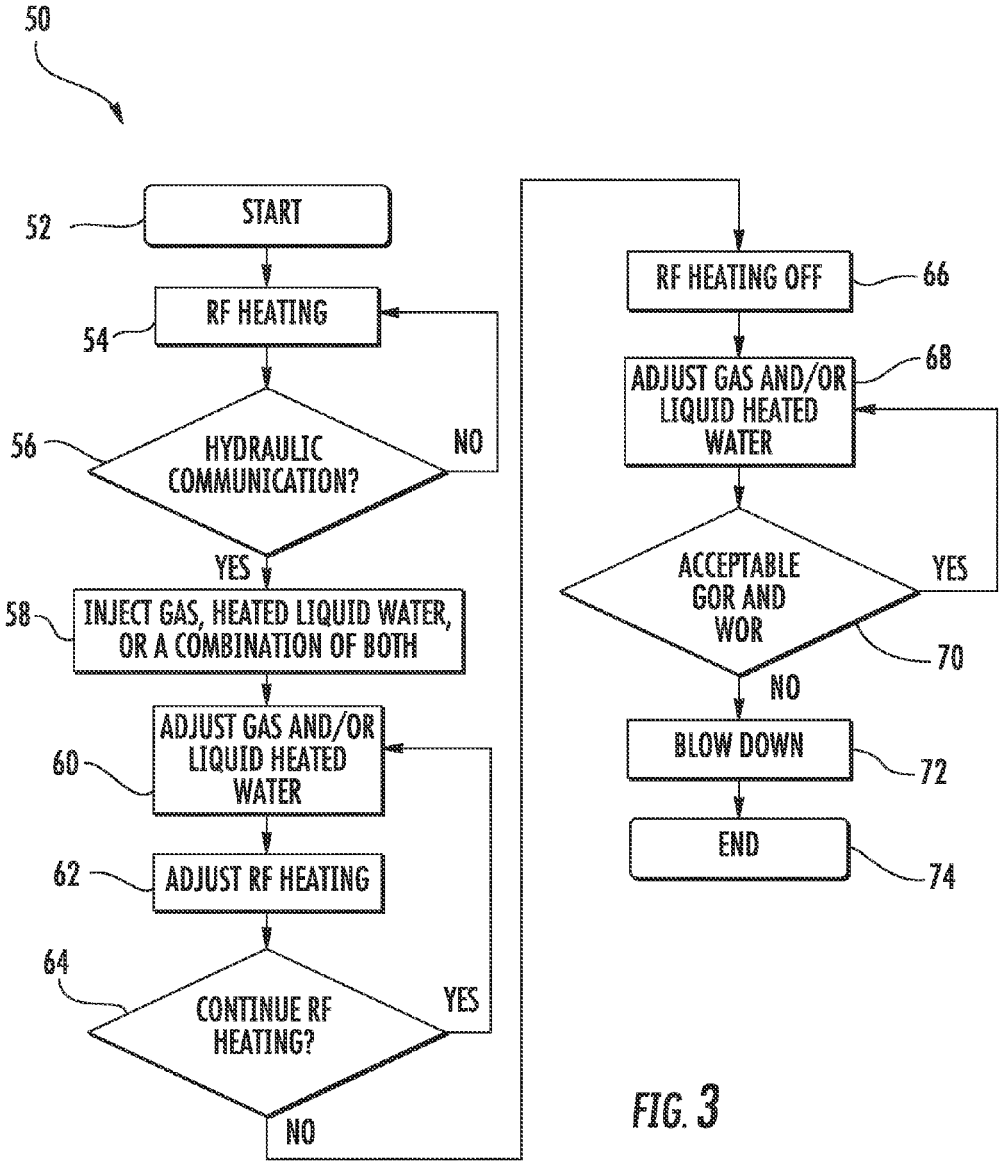
FIG. 3 is a more detailed flowchart for the method of the method in accordance with the present invention.

Referring now to the flowchart 50 in FIG. 3, a more detailed method of recovering a hydrocarbon resource in the subterranean formation 41 is described. Beginning at Block 52, the method includes, at Block 54, RF heating the subterranean formation 41, to establish hydraulic communication between the pair of spaced apart laterally extending injector wells 42*a*, 42*b*, and the producer well 43. To accomplish the RF heating, the method includes positioning respective RF applicators 44*a*-44*c* within the injector wells 42*a*, 42*b*, and the producer well 43. RF energy is supplied to each of the RF applicators 44.

Since a hydrocarbon resource in its native condition generally resists fluid injection, RF heating, which penetrates the subterranean formation 41, advantageously increases the temperature of the subterranean formation to a temperature at which the hydrocarbon resource becomes mobile, i.e. has a reduced viscosity to establish the hydraulic communication. At Block 56 a determination is made as to whether hydraulic communication has been established. If hydraulic communication has not been established, RF heating continues (Block 54).

Figure 4A:
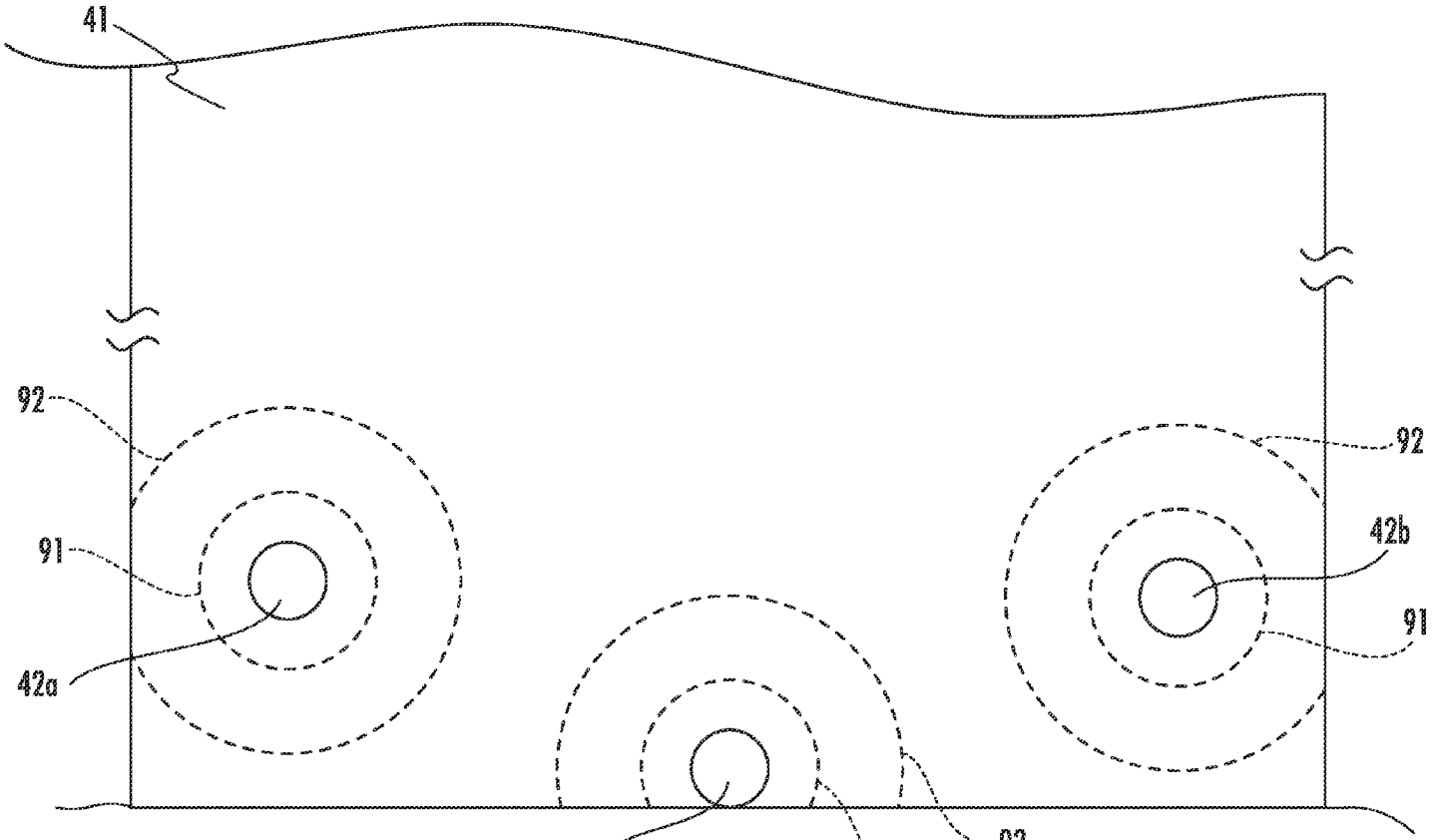
FIGS. 4*a*-4*b* are schematic cross-sectional views of the hydrocarbon bearing subterranean formation after the method steps of FIG. 3.

RF heating may continue for a time period of two years, for example, or to a desired temperature so that hydraulic communication is established. More particularly, the RF heating may continue until the subterranean formation 41 is at least 60° C., for example. The subterranean formation 41 may be, in many instances, in a temperature range of 4-10° C. prior to the RF heating. The duration of the RF heating may be based upon the temperature, fluid infectivity, and conditions of the subterranean formation as will be appreciated by those skilled in the art. To achieve the desired RF heating, 4 megawatts of power at a frequency in a range of 20 kHz-300 MHz, may be applied from the RF source 45 to each RF applicator 44, for example, for a 1000 meter zone. Other frequency ranges and powers may be used for the RF heating. FIG. 4*a* illustrates exemplary simulated first and second temperature contours 91, 92 extending radially outward from the pair of spaced apart laterally extending injector wells 42*a*, 42*b*, and the producer well 43 after RF heating.

Once it has been determined, at Block 56, that hydraulic communication has been established, a gas is injected into the pair of spaced apart laterally extending injector wells 42*a*, 42*b* at Block 58. The gas may include at least one of nitrogen, methane, propane, and an inert gas. As will be appreciated by those skilled in the art, the methane or propane may naturally be released from the hydrocarbon resource, for example, bitumen, by heating and pressure. A relatively small amount of a solvent gas may also be included to reduce viscosity of the hydrocarbon resource, for example. In some embodiments, the gas may be used in conjunction with the RE heating to establish the hydraulic communication.

At Block 58, heated liquid water is also injected along with the gas into the pair of spaced apart laterally extending injector wells 42*a*, 42*b* to recover hydrocarbon resources from the producer well 43. The heated liquid water is heated in a pressure vessel 46 above the subterranean formation 41. The heated liquid water is heated under pressure, for example, at 1.5 MPa, so that the boiling point is 200° C. The heated liquid water is injected at a pressure in a range of 0.4 to 4 MPa, and a temperature in a range of 100-200° C., and more particularly, 150° C. so that dissolved solids within the heated liquid water are not boiled out. In other words, hot liquid water is used and not steam.

The heated liquid water further heats the subterranean formation 41 to reduce the hydrocarbon viscosity and displace the hydrocarbon resource from each of the pair of spaced apart laterally extending injector wells 42*a*, 42*b* to the laterally extending producer well 43. Using injected heated liquid water versus steam in conventional SAGD, for example, to heat the subterranean formation 41 advantageously reduces the amount of energy consumed to displace the hydrocarbon resource, as an increase in temperature corresponds to an increase in energy consumed. As will be appreciated by those skilled in the art, an increased amount of energy is needed to change the steam from a liquid to a gas. More particularly, compared to conventional SAGD, a steam plant is typically not needed, and an amount of water treatment facilities may be reduced.

The heated liquid water injection may improve overall hydrocarbon recovery relative to a pure gas injection, for example, a non-condensable gas injection, as the heated liquid has a better mobility ratio with the hydrocarbon resource as compared to a gas. This may result in increased sweep efficiency and increased hydrocarbon recovery prior to breakthrough, as will be appreciated by those skilled in the art. The heated liquid water and gas may be injected for a time period of two years, for example, as after a total of three years (after one year of gas and heated liquid water injection), significant hydrocarbon resources have been recovered. After a total of four years, for example, a majority of the hydrocarbon resource may have been recovered. Longer or shorter water injection durations are also possible.

Figure 4B:
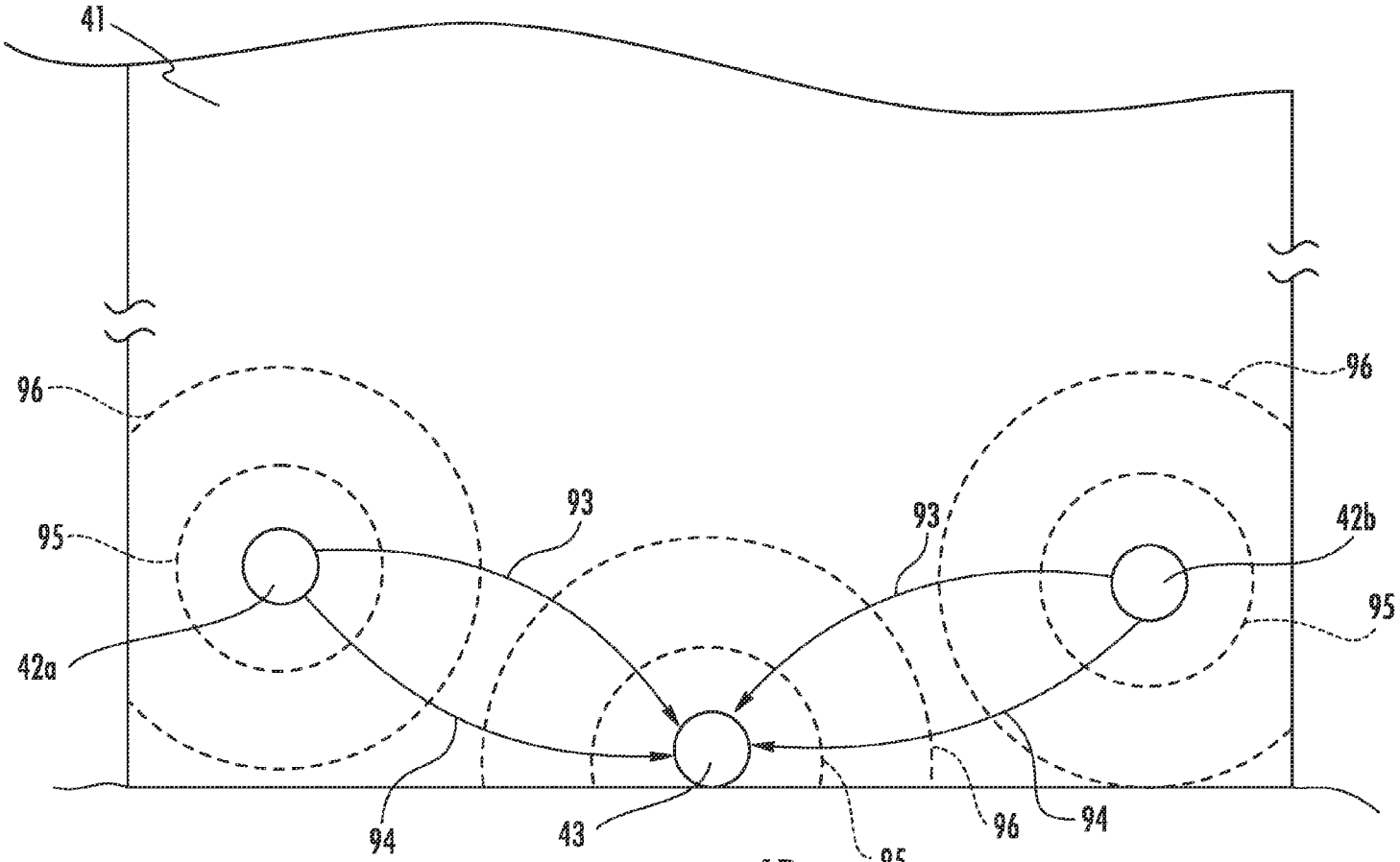

FIG. 4*b* illustrates the exemplary schematic first and second temperature contours 95, 96 extending radially outward from the pair of spaced apart laterally extending injector wells 42*a*, 42*b*, and the producer well 43 after the heated liquid water has been injected. The temperature contours 95, 96 are illustratively spaced further away from the injector wells 42*a*, 42*b*, and the producer well 43 as compared to the temperature contours 91, 92 in FIG. 4*a*. Lines 93, 94 indicate the heated liquid water flow after injection.

As will be appreciated by those skilled in the art, the RF heating preheats the subterranean formation 41 between the wells bringing the subterranean formation to a sufficient temperature so that the heated liquid water may be injected. As will be appreciated by those skilled in the art, preheating the subterranean formation 41 at any relatively significant distance away from a well with a fluid, for example, the heated liquid water, is increasingly difficult because the properties of the subterranean formation at the initial temperature, i.e. prior to RF heating, resist fluid injection. Initially, heating the subterranean formation 41, for example, the wellbore region, with a fluid thus proceeds through heat conduction which is relatively slow. Advantageously, RF heating generally does not require any injectivity to heat the subterranean formation 41. For example, in subterranean formations with relatively poor injectivity, traditional methods of introducing heat through gas or liquid injection may not possible without fracturing the subterranean formation.

At Block 60, the gas and heated liquid water are adjusted. More particularly, the ratio of gas to liquid heated water may be adjusted. The flow rate, the injection temperature, and the injection pressure of the heated liquid water and gas may also be adjusted. The adjustments may be made to increase performance based upon well production, for example.

At Block 62 the RF heating is adjusted. More particularly, the RF frequency and the RF power may be adjusted.

At Block 64, a determination is made as to whether RF heating should continue. The determination of whether RF heating should continue may be based upon performance or well production readings, for example, as will be appreciated by those skilled in the art. If the determination is made to continue RF heating, the method returns to Block 60 where further adjustments to the gas and heated liquid water are made. If the determination is made to discontinue RF heating, RF heating is turned off at Block 66. At Block 68, and after the RF heating has been discontinued, additional adjustments to the gas and heated liquid water are made, as described above with respect to Block 60.

While the heated liquid water is injected along with the gas, i.e. at a same time, in other embodiments, the gas may be injected alone, followed by the injection of the heated liquid water. Additionally, the injection of gas and heated liquid water may be alternated, and adjustments may be made to each with each injection, as will be appreciated by those skilled in the art.

A determination is made as to whether a gas/oil ratio and/or a water/oil ratio associated with the hydrocarbon resource production exceeds a threshold, for example, that may be indicative of an acceptable desired level (Block 70). If the gas/oil ratio and/or water/oil ratio has been exceeded or a desired ratio has been reached, the injection of the gas and heated liquid water is stopped and pressure is reduced via a blow down procedure (Block 72). In other words, when the GOR or WOR becomes too large to support economic recovery, the blow down procedure is initiated.

Alternatively, if the gas/oil ratio and/or water/oil ratio has not been exceeded or a desired ratio has not been reached, the gas and heated liquid water are again adjusted (Block 68). The method ends at Block 74.

Figure 5A:
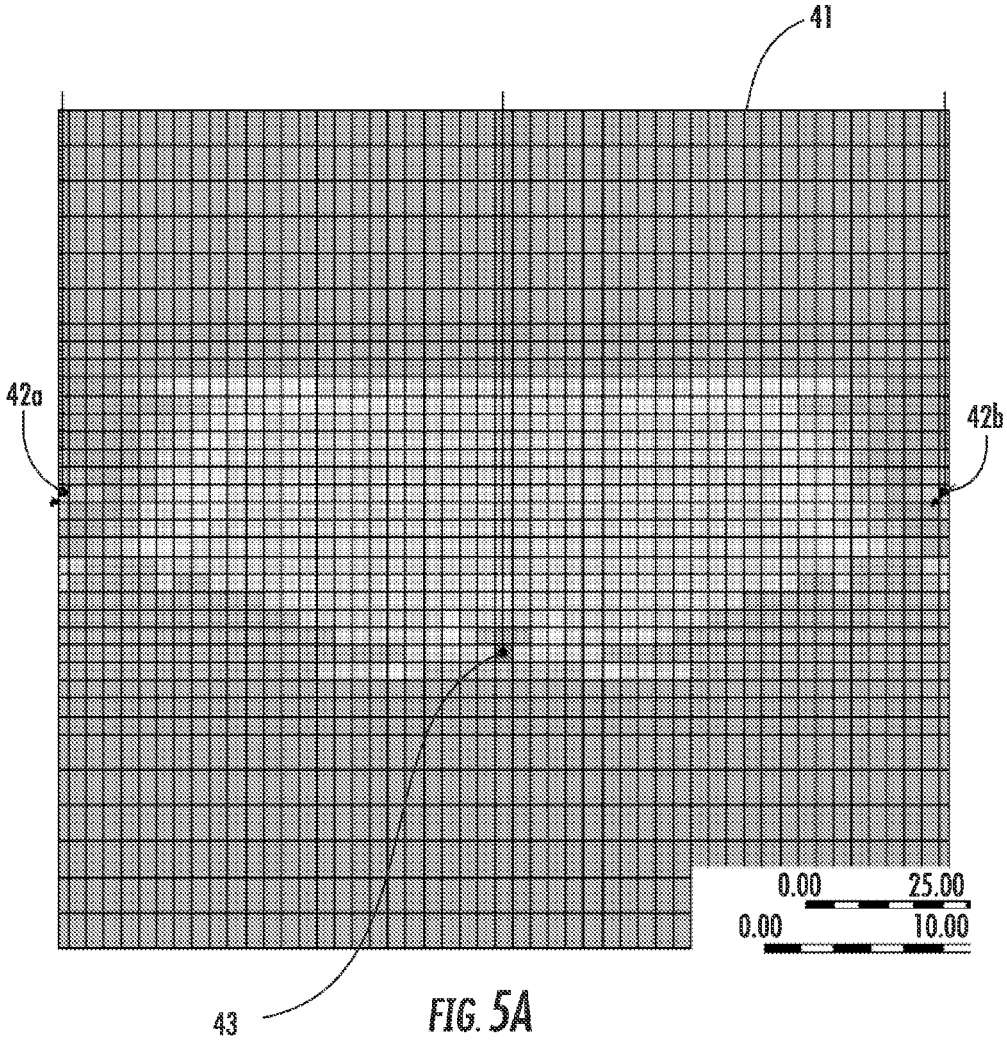
FIGS. 5*a*-5*c* are simulated hydrocarbon resource saturation graphs at different times during the hydrocarbon resource recovery method according to the present invention.
Figure 5B:
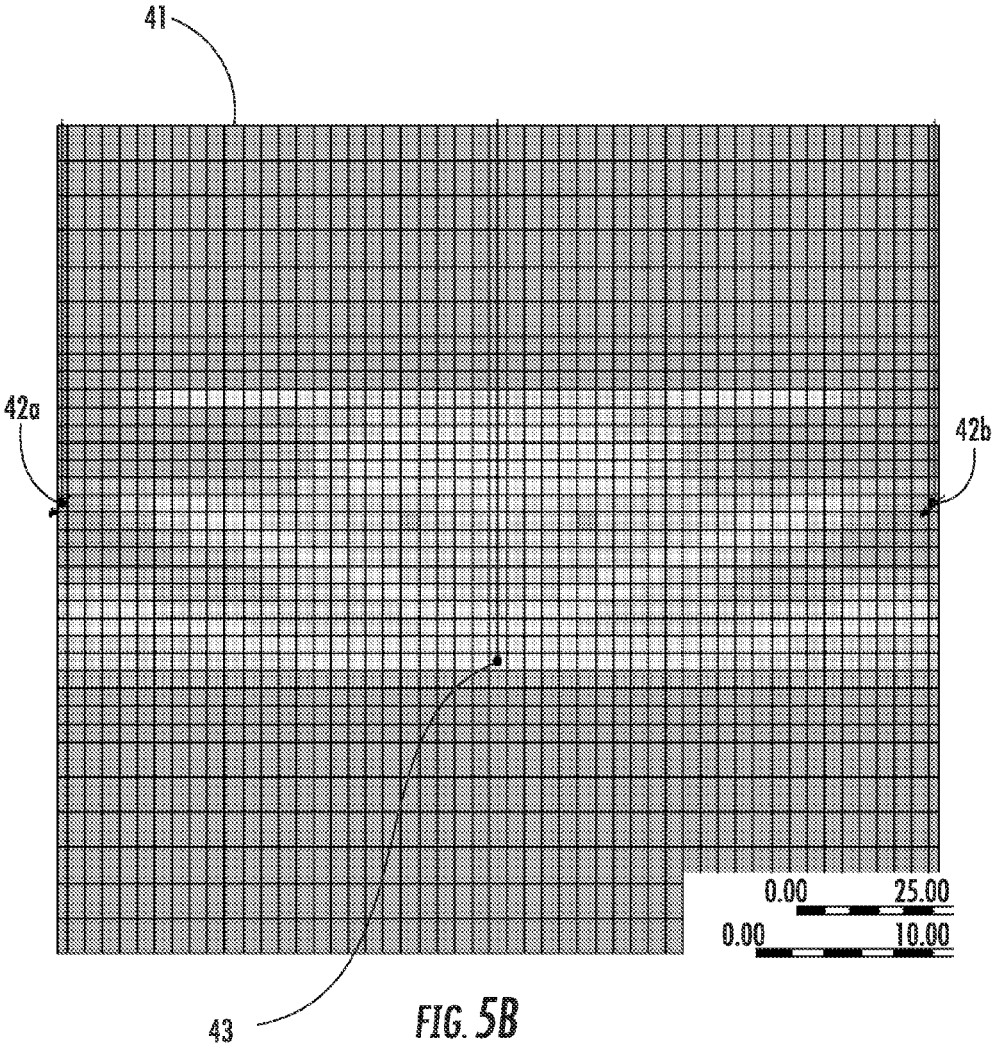
Figure 5C:
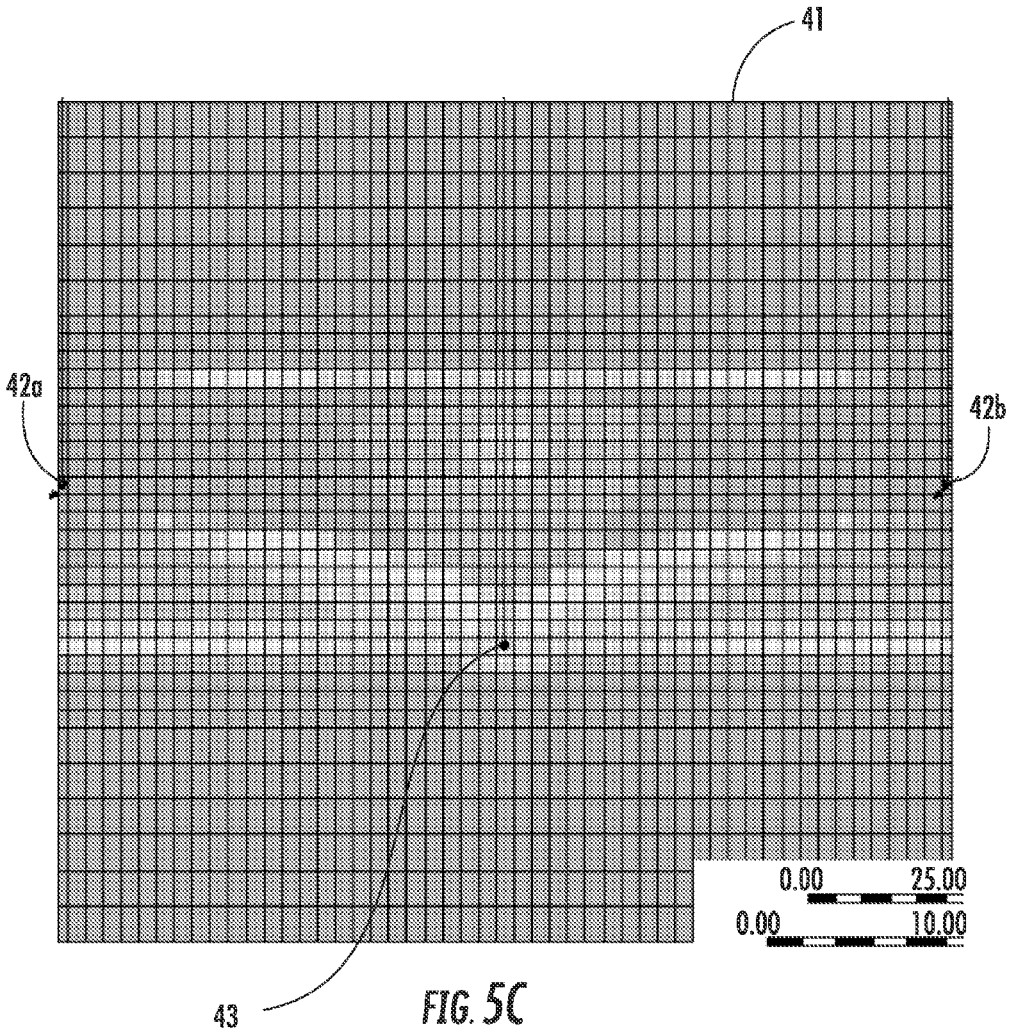

Referring now to the graph of FIGS. 5*a*-5*c*, simulated oil saturation after the different method steps are illustrated. The graph in FIG. 5*a* illustrates oil saturation after two years of RF heating. The subterranean formation is illustratively increased in temperature. Hydraulic communication has been established and gas and heated liquid water injection are started. The graph in FIG. 5*b* illustrates oil saturation after three years, or one year after starting gas and heated liquid injection. Relatively significant hydrocarbon resources have been produced by the gas and heated liquid water displacement. The graph in FIG. 5*c* illustrates oil saturation after four years, or two years after the initial injection of the gas and heated liquid water. The majority of the hydrocarbon resources have been recovered.

Figure 6:
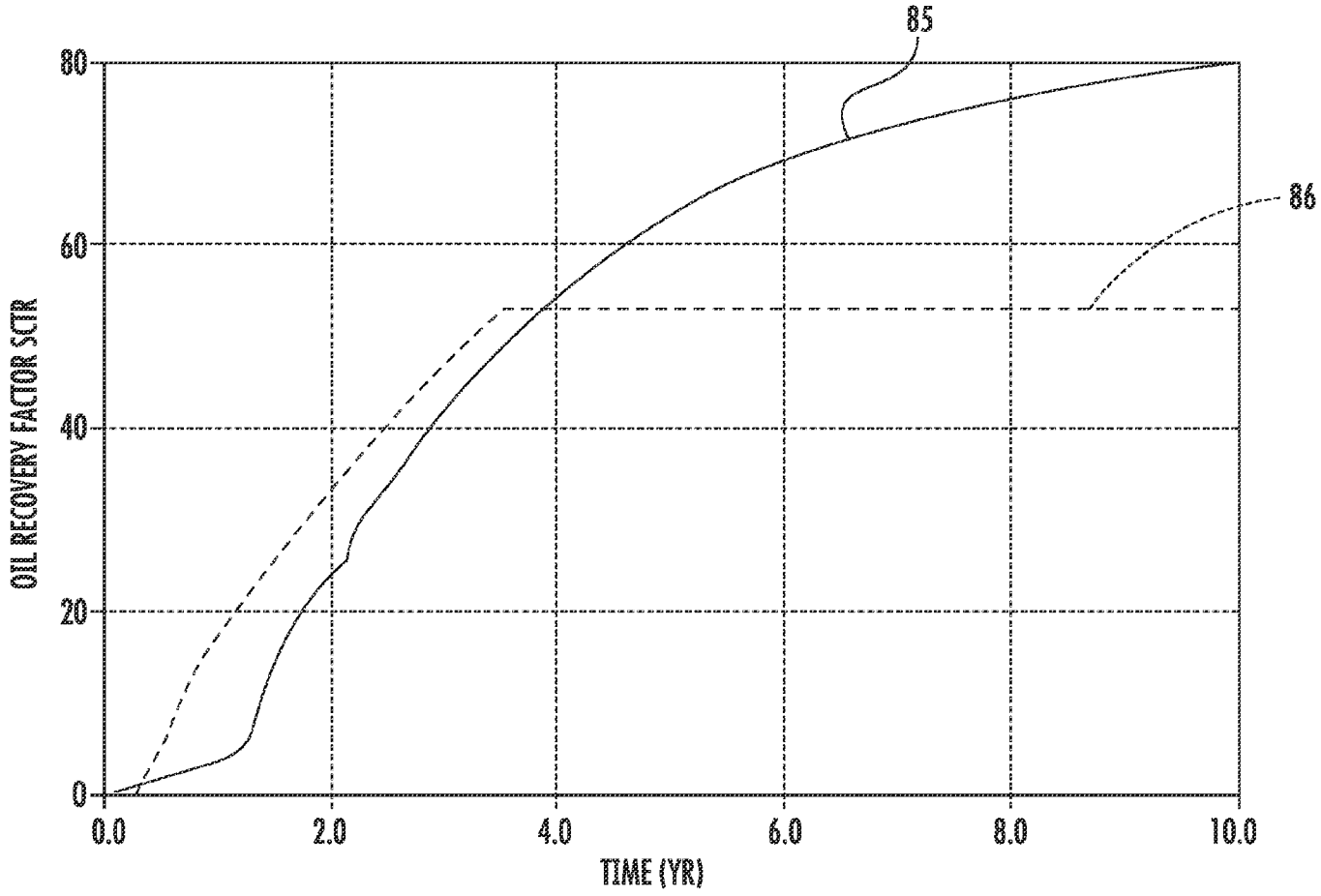
FIG. 6 is a graph of hydrocarbon resource production using the method according to claimed invention versus conventional SAGD, as in the prior art.

Referring now to FIG. 6, oil production is illustrated by the time versus oil recovery factor graph. The oil recovery factor recovered according to the present embodiments 85, is greater than conventional SAGO 86, and the oil recovery rate is relatively similar. Recovery acceleration is a function of applied RF energy, as will be appreciated by those skilled in the art.

Figure 7:
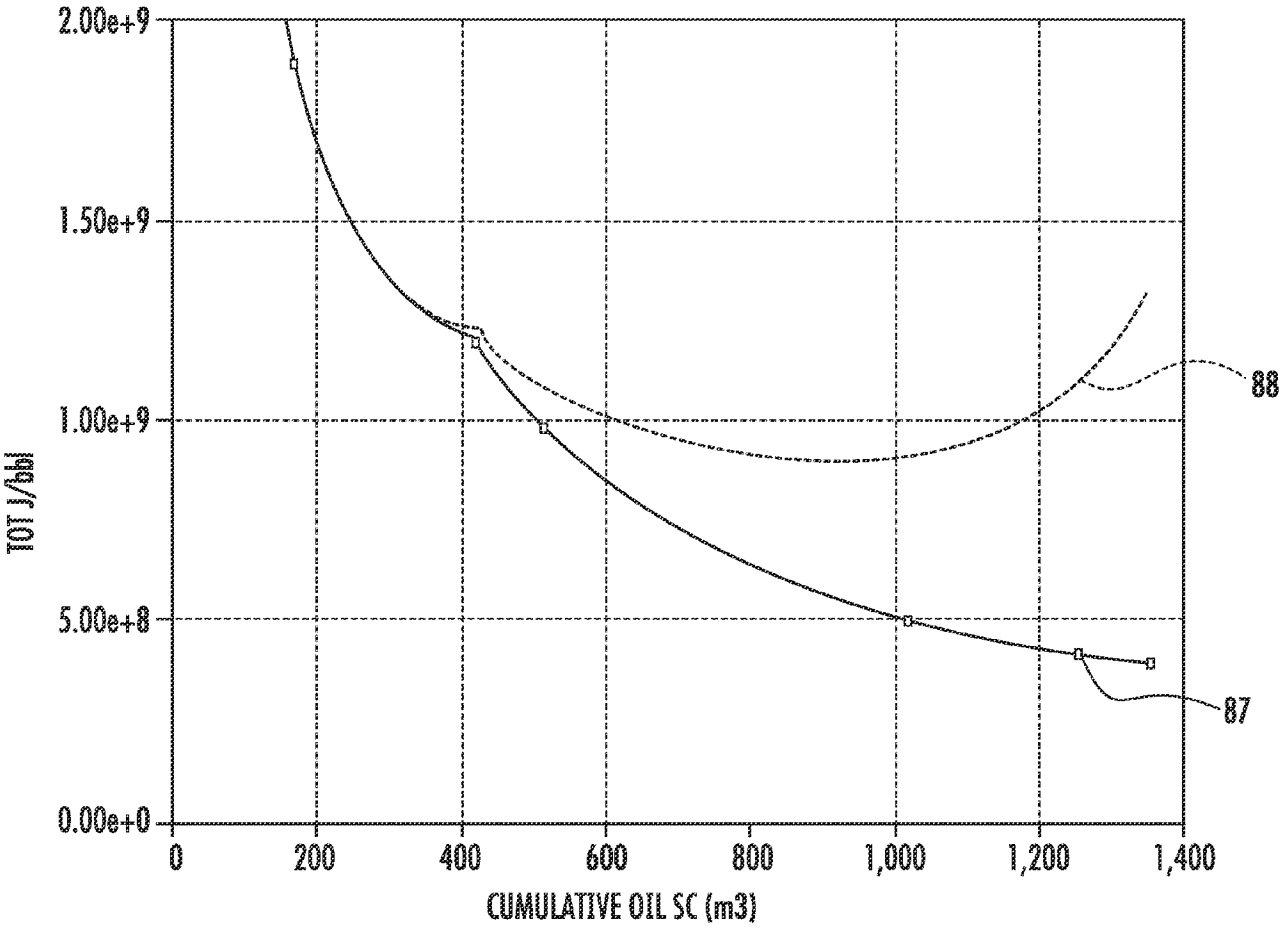
FIG. 7 is a graph of energy usage versus cumulative oil recovered according to the present invention.
Figure 8:
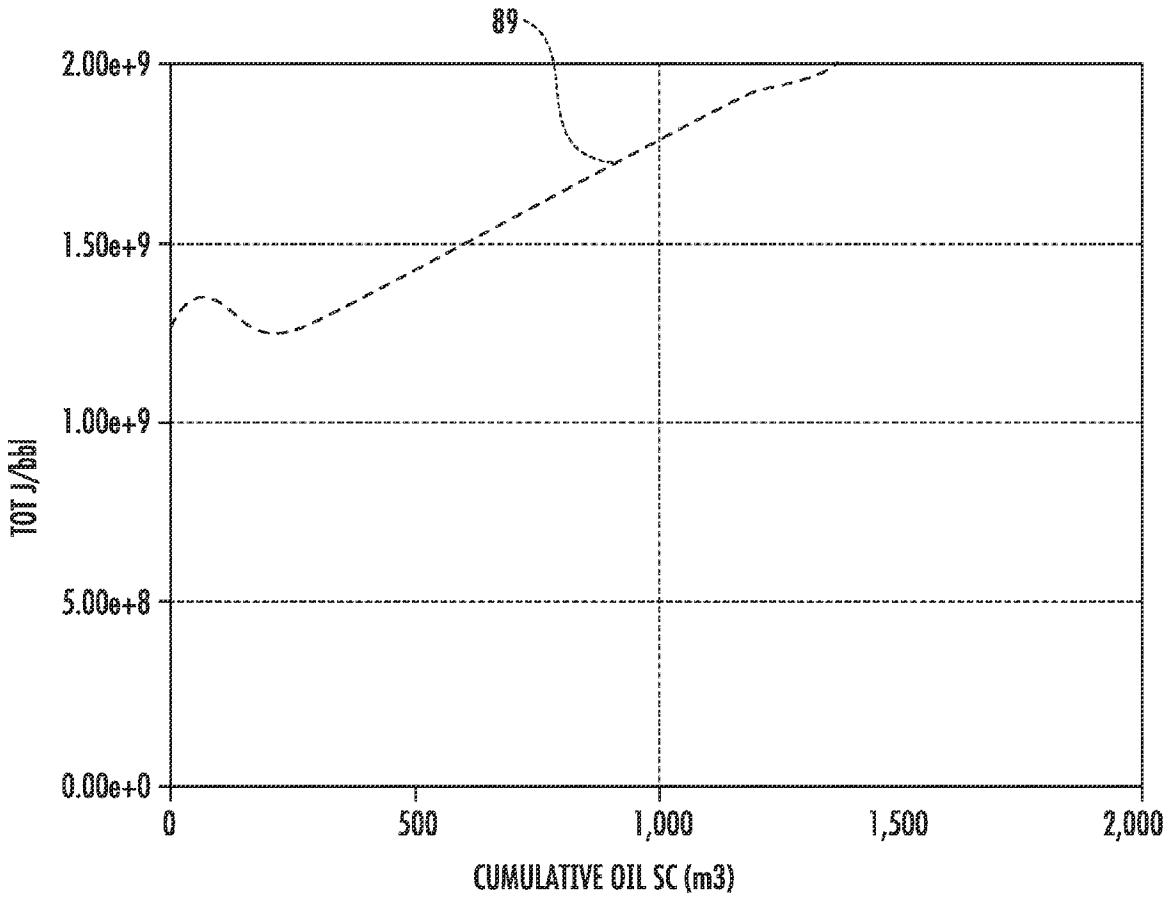
FIG. 8 PRIOR ART
FIG. 8 is a graph of energy usage versus cumulative oil recovered using only conventional SAGD as in the prior art.

Referring now to the graphs in FIGS. 7 and 8, the simulated energy comparison between hydrocarbon resource recovery according to the present embodiments (FIG. 7) versus conventional SAGD are illustrated (FIG. 8). The simulations were for a relatively thin payzone, for example, 15 meters, and not a relatively thick payzone, i.e. 30 meters. If, for example, energy were applied to a relatively thick payzone, the energy/bbl would be significantly less for both the present embodiments and conventional SAGD even though the present embodiments would be proportionately better than the conventional SAGD.

The total energy per barrel is illustrated by the line 88, while the RF energy is illustrated by the line 87. The present embodiments reduce the total energy compared to conventional SAGD. In particular, the present embodiments use about 0.9 GJ/bbl at about 60% of the original oil in place (OOIP) for a simulation of a five meter length axial segment of a well. Full scale well results can be extrapolated by using a ratio of the well length to the five meter length simulation (FIG. 7). In contrast, conventional SAGD uses about 1.8 GJ/bbl at 60% OOIP (≈1,000 $m^3$ for a simulated 5 meter domain length) as illustrated by the line 89 (FIG. 8). As noted above the 1.8 GJ/bbl corresponds to a relatively thin payzone. The use of heated liquid water advantageously reduces the amount of electricity used in recovering the hydrocarbon resource. In particular, in the present embodiments, RF electricity is about 0.5 GJ/bbl at 60% OOIP for a relatively thin payzone. Accordingly, electricity may be traded against heated liquid water usages to achieve lower electricity consumption, as will be appreciated by those skilled in the art.

TABLE 1

| | Normalized Recovery Time | WOR | Total (GJ/bbl) | RF (GJ/bbl) |
|---|---|---|---|---|
| SAGD | 1 | 4.5 | 1.94 | N/A |
| RF + gas + hot water (1) | 1.1 | 4.2 | 0.9 | 0.5 |
| RF + gas + hot water (2) | 1.6 | 7.4 | 0.9 | 0.25 |

Table 1 above summarizes performance at an equivalent hydrocarbon recovery factor of 60% in a 15 meter thick payzone.

Many modifications and other embodiments of the invention will come to the mind of one skilled in the art having the benefit of the teachings presented in the foregoing descriptions and the associated drawings. Accordingly, it is understood that the invention is not to be limited to the embodiments disclosed, and that other modifications and embodiments are intended to be included within the spirit and scope of the appended claims.

That which is claimed is:

1. A method for hydrocarbon resource recovery in a subterranean formation comprising:

forming a laterally extending injector well in the subterranean formation;

forming a laterally extending producer well spaced below the injector well;

radio frequency (RF) heating the subterranean formation to establish hydraulic communication between the injector well and the producer well;

injecting at least one of an inert gas, propane, and methane into the injector well to assist with the hydraulic communication between the injector well and the producer well by at least displacing hydrocarbon resources from the injector well to the producer well;

determining whether hydraulic communication has been established between the injector well and the producer well; and when hydraulic communication has been established between the injector well and the producer well, injecting heated liquid water into the injector well to recover the hydrocarbon resources from the producer well based upon the hydraulic communication therebetween.

2. The method of claim 1, further comprising positioning a respective RF applicator within the injector well and the producer well; and wherein RF heating comprises supplying RF energy to each of the RF applicators.

3. The method of claim 1, further comprising forming an additional laterally extending injector well in the subterranean formation spaced apart from the injector well to define a pair of laterally spaced apart injector wells; and wherein the producer well is formed between the pair of injector wells.

4. The method of claim 3, wherein forming the producer well comprises forming the producer well midway between the pair of spaced apart injector wells.

5. The method of claim 1, further comprising heating liquid water in a pressure vessel above the subterranean formation to define the heated liquid water.

6. The method of claim 1, wherein injecting the heating liquid water comprises injecting the liquid heated water at a pressure in a range of 0.4 to 4 MPa, and a temperature in a range of 100-200° C.

7. The method of claim 1, wherein injecting the at least one of the inert gas, propane, and methane comprises injecting the at least one of the inert gas, propane, and methane before the heated liquid water is injected.

8. The method of claim 1, wherein injecting the at least one of the inert gas, propane, and methane comprises injecting the at least one of the inert gas, propane, and methane after the RF heating.

9. The method of claim 1, wherein injecting the at least one of the inert gas, propane, and methane and injecting the heated liquid water comprises injecting the at least one of the inert gas, propane, and methane and injecting the heated liquid water at a same time.

10. The method of claim 1, wherein injecting the at least one of the inert gas, propane, and methane into the injector well to assist with the hydraulic communication between the injector well and the producer well comprises injecting the at least one of the inert gas, propane, and methane into the injector well to establish hydraulic communication between the injector well and the producer well.

11. The method of claim 1, wherein injecting the at least one of the inert gas, propane, and methane into the injector well to assist with the hydraulic communication between the injector well and the producer well comprises injecting the at least one of the inert gas, propane, and methane into the injector well to maintain hydraulic communication between the injector well and the producer well.

12. A method for hydrocarbon resource recovery in a subterranean formation comprising a laterally extending injector well in the subterranean formation, and a laterally extending producer well spaced below the injector well, the method comprising:

radio frequency (RF) heating the subterranean formation to establish hydraulic communication between the injector well and the producer well;

injecting at least one of an inert gas, propane, and methane into the injector well to assist with the hydraulic communication between the injector well and the producer well by at least displacing hydrocarbon resources from the injector well to the producer well;

determining whether hydraulic communication has been established between the injector well and the producer well; and when hydraulic communication has been established between the injector well and the producer well, injecting heated liquid water into the injector well to recover the hydrocarbon resources from the producer well based upon the hydraulic communication therebetween.

13. The method of claim 12, further comprising positioning at least one respective RF applicator within the injector well and the producer well; and wherein RF heating comprises supplying RF energy to each of the RF applicators.

14. The method of claim 12, further comprising heating liquid water in a pressure vessel above the subterranean formation to define the liquid heated water.

15. The method of claim 12, wherein injecting the heated liquid water comprises injecting the heated liquid water at a pressure in a range of 0.4 to 4 MPa, and a temperature in a range of 100-200° C.

16. The method of claim 12, wherein injecting the at least one of the inert gas, propane, and methane comprises injecting the at least one of the inert gas, propane, and methane before the heated liquid water is injected.

17. The method of claim 12, wherein injecting the at least one of the inert gas, propane, and methane comprises injecting the at least one of the inert gas, propane, and methane after the RF heating.

18. The method of claim 12, wherein injecting the at least one of the inert gas, propane, and methane and injecting the heated liquid water comprises injecting the at least one of the inert gas, propane, and methane and injecting the heated liquid water at a same time.

19. The method of claim 12, wherein injecting the at least one of the inert gas, propane, and methane into the injector well to assist with the hydraulic communication between the injector well and the producer well comprises injecting the at least one of the inert gas, propane, and methane into the injector well to establish hydraulic communication between the injector well and the producer well.

20. The method of claim 12, wherein injecting the at least one of the inert gas, propane, and methane into the injector well to assist with the hydraulic communication between the injector well and the producer well comprises injecting the at least one of the inert gas, propane, and methane into the injector well to maintain hydraulic communication between the injector well and the producer well.

21. A method for hydrocarbon resource recovery in a subterranean formation comprising a laterally extending injector well in the subterranean formation, and a laterally extending producer well spaced below the injector well, the method comprising:

radio frequency (RF) heating the subterranean formation to establish hydraulic communication between the injector well and the producer well;

injecting at least one of an inert gas, propane, and methane into the injector well to reduce viscosity of hydrocarbon resources;

determining whether hydraulic communication has been established between the injector well and the producer well; and when hydraulic communication has been established between the injector well and the producer well, injecting heated liquid water into the injector well to recover the hydrocarbon resources from the producer well based upon the hydraulic communication therebetween, the heated liquid water being defined by heating liquid water in a pressure vessel above the subterranean formation.

22. The method of claim 21, further comprising positioning at least one respective RF applicator within the injector well and the producer well; and wherein RF heating comprises supplying RF energy to each of the RF applicators.

23. The method of claim 22, wherein injecting the at least one of the inert gas, propane, and methane and injecting the heated liquid water comprises injecting the at least one of the inert gas, propane, and methane and injecting the heated liquid water at a same time.

24. The method of claim 21, wherein injecting the liquid heated water comprising injecting the heated liquid water at a pressure in a range of 0.4 to 4 MPa, and a temperature in a range of 100-200° C.

25. The method of claim 21, wherein injecting the at least one of the inert gas, propane, and methane comprises injecting the at least one of the inert gas, propane, and methane before the heated liquid water is injected.

26. The method of claim 21, wherein injecting the at least one of the inert gas, propane, and methane comprises injecting the at least one of the inert gas, propane, and methane after the RF heating.

* * * * *